United States Patent [19]

Freed et al.

[11] Patent Number: 5,007,766

[45] Date of Patent: Apr. 16, 1991

[54] SHAPED BARRIER FOR EROSION CONTROL AND SEDIMENT COLLECTION

[75] Inventors: W. Wayne Freed, Signal Mountain; Robert M. Smith, Ooltewah, both of Tenn.

[73] Assignee: Synthetic Industries, Inc., Chickamauga, Ga.

[21] Appl. No.: 441,513

[22] Filed: Nov. 27, 1989

Related U.S. Application Data

[63] Continuation-in-part of Ser. No. 383,878, Jul. 21, 1989.

[51] Int. Cl.[5] ..... E02B 3/04

[52] U.S. Cl. ..... 405/24; 405/25; 405/32; 405/74

[58] Field of Search ..... 405/15, 19, 21, 23, 405/24, 25, 28, 32, 33, 52, 73, 74; 15/176.3

[56] References Cited

U.S. PATENT DOCUMENTS

| | | | |
|---|---|---|---|
| 56,025 | 7/1866 | Figer | 15/176.3 |
| 2,071,779 | 2/1937 | Willing | 405/19 |
| 3,517,514 | 6/1970 | Visser | 405/19 |
| 4,610,568 | 9/1986 | Koerner | 405/19 |
| 4,657,432 | 4/1987 | Retrop et al. | 405/24 |
| 4,832,557 | 5/1989 | Jacobsen | 405/19 X |

FOREIGN PATENT DOCUMENTS

| | | | |
|---|---|---|---|
| 220385 | 9/1957 | Australia | 405/19 |
| 740614 | 8/1966 | Canada | 405/24 |
| 2101124 | 9/1971 | Fed. Rep. of Germany | 405/21 |
| 1176722 | 1/1970 | United Kingdom | 405/24 |
| 2127469 | 4/1984 | United Kingdom | 405/24 |

*Primary Examiner*—Dennis L. Taylor
*Assistant Examiner*—Arlen L. Olsen
*Attorney, Agent, or Firm*—Jones, Askew & Lunsford

[57] ABSTRACT

Sediment barrier for reducing the erosive energy of water flow through on a watercourse such as a surface, a rill or similar channel, and for increasing the deposition of sediments therein. The sediment barrier includes a plurality of individual strands emanating outwardly from a foundation common to all the strands, and forming a structured flow-permeable array having a certain shape to extend outwardly from the watercourse on which the barrier is placed. The individual strands preferably are crimped or otherwise distorted in external configuration so as to provide fiber-to-fiber cohesion which helps maintain the overall array of the barrier. The sediment barrier is anchored in place on a surface or within a rill or gully, so as to maintain the strands in upright relation to the watercourse.

11 Claims, 3 Drawing Sheets

SHAPED BARRIER FOR EROSION CONTROL AND SEDIMENT COLLECTION

RELATED APPLICATION

This is a continuation-in-part of Ser. No. 383,878 filed Jul. 21, 1989.

FIELD OF INVENTION

This invention relates in general to the control of soil erosion caused by water flow, and relates in particular to a method and apparatus for reducing the erosive force of water flow in rills and other watercourses and for inducing sedimentation from those flows.

BACKGROUND OF THE INVENTION

Erosion is the detachment and movement of soil particles or geologic material through naturally-occurring processes such as wind, rain, and running water occurring either as overland flows or as concentrated flows. Surface water runoff is the primary cause of erosion. Overland flow occurs when the rainfall rate exceeds the rate of infiltration and evaporation for a particular kind of soil, once the detention storage capacity of the soil becomes filled. Topographical features such as slope length and slope gradient also influence erosion. Soil texture, classification and compaction, and ground cover such as vegetation and rocks are other influencing factors.

Erosion occurs when the protective vegetative cover and organic layer are removed from mineral soils. Although raindrops and splash erosion are concerns relating to dislodging and transporting soil particles, this invention primarily deals with reducing sheet, rill and gully erosion forces and inducing the deposition of sediment entrained in concentrated flows of water. Erosion takes place when surface water runoff, the transporting agent for particles of soil, has enough energy to entrain and move sediment. This energy is a function of the amount and velocity of water passing over a given area in a given time. Accelerated erosion rates cause rills and gullys, indicating the erosive forces are overcoming the slope resistance.

Sheet erosion occurs when water flows along the surface of a slope with energy sufficient to entrain said on the slope, without cutting a particular channel into the surface. Rill erosion occurs once there is concentrated flow with enough energy to incise the surface of a slope. At this stage, the shear force of the flow exceeds the shear resistance of the surface. Gullys become formed downslope of rills, often through the interception of more than one rill. The additive flow from several rills increases the erosive energy, causing further incision of the surface. Rills over one foot deep are generally considered gullys. Gullys are a significant form of direct erosion by surface water runoff, and it is desirable to prevent gullys by controlling the growth of rills.

Prior art attempts to control soil erosion arising from surface water runoff generally have relied on mats or blankets made from natural or manmade fibers being placed on the ground surface to protect the surface from the erosive effect of wind or water movement over the surface. Slope control, while vegetation takes hold on the surface, has been the principal application of such mats. Typical mats for the purpose are flexible or semiflexible sheets manufactured to predetemined dimensions, and provided with a scrim or other mechanical structure providing a framework for defining and maintaining the dimensional stability of the structure. U.S. Pat. No. 4,610,568 entitled "Slope Stabilization System and Method" discloses a fabric layered mat of that general kind. These manufactured structures typically must be cut in the field to fit a particular surface of application, a procedure which is time-consuming and awkward as the natural slope and shape of the soil seldom conforms to the relatively linear shapes of such manufactured products. This problem is particularly evident when attempting to fit existing erosion-control mats into the existing irregular cross-sectional shapes of rills or gullys.

Other attempts to control erosive flow through rills and gullys include emplacing bales of hay or straw within the gully. The overall external shapes of such bales are effectively fixed during the baling process, and those shapes thus are not readily conformable to the irregular areas of gullys or rills. Hay bales present the further disadvantage of acting like a dam to block the water flow. The water will go around or over the bale when the rill or gully becomes flooded. The velocity of this water is increased in the bypass region and therefore has a much greater erosive force. Moreover, hay or straw and the twine used to bind the bales usually biodegrade at so rapid a rate that the structural integrity of the bales is lost before the rill or gully becomes effectively blocked by the process of sedimentation.

Other methods of erosion control include the use of woven, generally open-cell natural or manmade fiber yarns which protect the slope, vegetation and plants early in their growth process. Scattering bark or mulch and the use of spray mulch are additional devices for temporary slope control. These methods are used early in the construction or reconstruction process for steep to moderate slopes. Once in place, the fabrics or other materials biodegrade or photodegrade. Should there be a failure of the vegetative or armoring process, channels form with progressing impact on the erosive action phenomenon.

SUMMARY OF INVENTION

This invention is designed for localized use to prevent or reduce the effect of sheet erosion, and to induce self-rehabilitation of rills and other relatively small channels formed early in the erosion process. The invention incorporates the two basic principles of erosion control. Firstly, the invention reduces the erosive energy of overland water flow by passing the flow through a fibrous mass anchored in areas of concentrated flow, thereby reducing the velocity and energy of the flow. Secondly, as the resistance of the fibrous mass reduces the flow energy, the rate of deposition of sediment or other eroding materials is increased, entrapping eroding sediment before the particles of sediment can leave the site.

Stated in general terms, this invention comprises a shaped array of relatively stiff fibers or yarns that is placed on or in a watercourse subject to erosion and is permeable to water flow along that watercourse. The shaped array is installed on a slope subject to sheet erosion, or is introduced into a rill or other relatively small channel hereafter generically identified as a channel. The array has a predetermined overall shape which spans the channel or other region and is there anchored in place, but which has sufficient flexibility to conform to the contour of the channel or the surface. The array thereafter performs as a resistance to water flow through the array and as a sediment barrier tending to increase sedimentation of the water flowing through the mass.

Stated somewhat more specifically, the present invention includes a permeable barrier array for controlling erosion and effecting sediment collection. The barrier array is regular in its shape, and preferably includes a plurality of strands or fibers emanating from a foundation common to all the strands. The strands are disposed in a structured array having a certain predetermined shape, and are engaged at the foundation so as to unite the strands and thereby maintain the structural shape of the array. The discrete fibers or strands have sufficient fiber-to-fiber cohesion to help give the overall array the desired cohesion and thus improve the flow-reduction and sedimentation-increasing characteristics of the barrier. Fiber-to-fiber cohesion is induced by crimping or otherwise distorting the external configuration of the fibers, thereby creating an interfibrous friction or interlocking causing a degree of bundle cohesion between adjacent discrete fibers. The array of strands is configured to fit across the width of a channel, and in a preferred form has a brush-shaped configuration to assist in spanning the channel or other area. A staple or other ground-engaging member is assembled with or attached to the array for use in securing the array in place. The present barrier array is particularly suited for fabrication and sale in one or several predetermined sizes and shapes, and thus is especially suited for use by persons lacking any particular expertise in fabricating or installing erosion control barriers.

It is, therefore, an object of the present invention to provide an improved apparatus and method for erosion control and sediment collection.

It is another object of the present invention to provide a method and apparatus for reducing the erosive energy of overland water flow on a slope or through a rill or other channel.

It is a further object of the present invention to entrap erosion sediments carried by water flow through a water flow channel, thereby promoting localized rehabilitation of the channel.

The foregoing and other objects of the present invention, together with the advantages thereof over known methods of treating on-site erosion channels, will become apparent from the specification which follows.

DETAILED DESCRIPTION OF PREFERRED EMBODIMENTS

Figure 1:
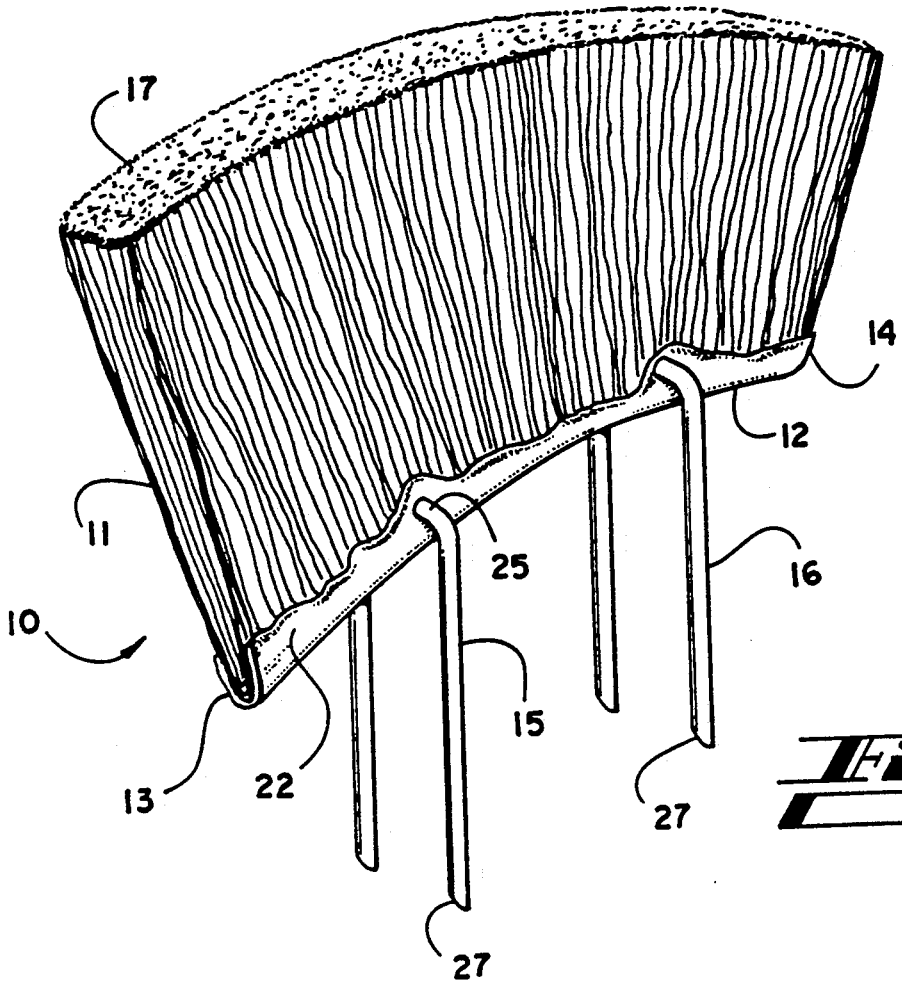
FIG. 1 is a pictorial view showing a rill barrier according to a first preferred embodiment of the present invention.
Figure 2:
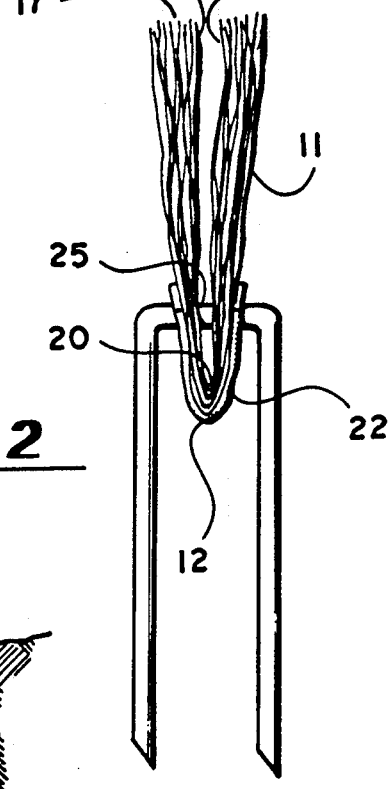
FIG. 2 is a sectioned end view of the rill barrier shown in FIG. 1.

Turning first to FIGS. 1 and 2, there is shown generally at 10 a barrier intended particularly for placement in relatively small water flow channels such as rills or the like. The barrier 10 comprises numerous individual strands or fibers 11 extending outwardly from a foundation 12 which comprises the lowermost edge of the barrier. The numerous strands 11 are laid adjacent one another in a substantially parallel fashion as pointed out more specifically below, so that the barrier 10 forms a structured array of strands having a certain predetermined shape. For example, the barrier 10 shown in FIGS. 1 and 2 has roughly the shape of a brush extending from one end 13 of the barrier to the other end 14 thereof. A pair of anchors 15 and 16 engage the foundation 12 of the barrier, spaced a short distance inwardly from the respective ends 13 and 14 of the barrier, and these anchors are used to secure the barrier within a channel.

FIG. 2 illustrates in greater detail the arrangement of individual strands 11 making up the barrier 10. Each strand 11, in the disclosed embodiment, is a discrete length of fiber folded double against itself to form a U-configuration, with the closed end 20 of each folded strand being located at the foundation 12 of the barrier. Thus, each strand 11 of a typical barrier 10 comprises strand segments **21*a* and 21*b*, each strand segment being approximately one-half the length of the complete strand 11**.

The strands 11, folded as described in the previous paragraph and laid alongside each other to form the approximate fan array shown in FIG. 1, are maintained in that certain array shape by applying an adhesive material 22 making up the foundation 12 along the length of the barrier 10. The foundation 12 may be flexible or inflexible; although a flexible base will aid in conforming to the region of installation, a nonflexible base may be required in some installations. In the embodiment of FIG. 1, the adhesive material secures the strands 11 to maintain the predetermined structure of the arrayed strands and thus unites the strands to form the barrier 10. The adhesive material exhibits some flexibility after becoming set or hardened, thereby permitting the foundation 12 of the barrier a degree of flexibility which allows conforming the overall longitudinal extent of the barrier to fit within a particular watercourse channel. However, the adhesive material 22 substantially maintains the predetermined shape of the structured array, namely, individual strands 11 which fan outwardly from the foundation 12 to form a generally-flat array of strands, in the particular embodiment being described. The adhesive material 22 may be a hot-melt adhesive, although other materials for the foundation 12 will be apparent to those of ordinary skill in the art. As an alternative to the use of adhesive for the foundation, the strands 11 can be inserted in a flexible base of woven or nonwoven material having the function of backing in a tufted carpet construction.

Although the individual strands 11 making up the barrier 10 are discrete and lie in approximately side-by-side parallel relation to adjacent strands, the adjacent strands preferably are interlocked or frictionally engaged with with one another so that the barrier 10 constitutes a fibrous mass formed from a plurality of discrete strands. This engagement may be provided with strands comprising discrete artificial fibers which are crimped or otherwise distorted in external configuration so as to provide sufficient fiber-to-fiber cohesion such that the resulting mass of fibers, while maintaining the predetermined structured array (such as the brush-like shape shown in FIG. 1) set by the initial alignment of the strands 11, provides a unitary interwoven mass tending to increase resistance to water flow through the barrier. The amount or number of fiber strands making up a particular barrier 10, and the thickness of the barrier as measured in the lateral direction viewed in FIG. 2, are determined by variables including the size of the erosion channel, the types and fineness of the concerned sediments flowing through that channel, the position of the barrier within the channel in relation to anticipated water velocity, and perhaps even to climate and related rainfall.

Preferred fibers for sediment barriers according to the present invention include the olefins, particularly polypropylene, polyesters, nylons, acrylics and glass, but are not limited to these. Typically, thermoplastic fibers having specific gravities ranging from 0.80 to 1.96 and fiberglass with a specific gravity range of about 2.50 to 2.70 are suitable. As most manmade fibers are photodegradable, ultraviolet stabilizers are deemed necessary for the fibers and yarns used in the sediment barriers unless service for less than 2–4 months is expected. UV stabilizers and color additives may be a design feature of the constituent fibers or yarns.

For purposes of stand-alone efficiencies, the fiber cross-sections should be of such size that when held horizontally there is little or no bending along the fiber length. This would normally denote a monofilament fiber for economics, although a coated or bonded filament or fibrillated film yarn fiber would also be effective. Fibers for the embodiments disclosed herein are constructed from 300 denier (0.22 mm diameter) to 500 denier (0.28 mm diameter) polypropylene monofilaments. These fibers are crimped in a random pattern and cut to lengths necessary for the desired length of the barrier from foundation 12 to outer end 17.

Other design factors relevant for fiber cross-section are filtration and barrier mass cohesion. While certain fiber stiffness is required to maintain resistance to flow, filtration of sediment is also a consideration. It is, therefore, probable that certain composite blends of fibers ranging in size from 60 denier to about 5000 denier might be appropriate. Fiber type and inherent stiffness will influence selection.

Bundle cohesion of discrete fibers generally is a function of crimping, slubbing, spiraling, cork-screwing or similar deformation to induce fiber to fiber cohesion. Fiber length is determined by the desired length of the barrier as measured from the foundation 12 to the outer end 17 of the barrier and this desired length is generally determined by the intended use for a particular barrier. For example, the preferred length range for a rill barrier is 3.0 to 6.0-in., though there is no practical limitation on either side of this range other than effectiveness of the barrier in impeding water flow through a rill and increasing sedimentation from that flow.

While discrete fibers are preferred, an array of continuous strand yarns can perform in essentially the same fashion. Generally, an array of continuous strand fiber would have loops instead of cut ends at the outer end 17 of the barrier.

Fiber configuration is important to strand stiffness, cohesion, water adhesion and sediment filtration. Favorable results are obtained with round cross-section monofilament discrete fibers and rectangular cross-section slit film continuous strand sediment barriers. Yet other fiber configurations such as oval, square, hollow, tri-lobal, multilobal, fibrillated, collated, bonded, entangled, multifilaments, monofilaments, or roll embossed film yarn are practical for use with sediment barriers according to the present invention.

Biological concerns may dictate fiber types used with the sediment barriers. Polypropylene as used in the examples herein is photodegradable and will eventually degrade in sunlight above-ground while maintaining its integrity in the soil. Current practice in erosion control mats calls for maintaining at least 70% strand strength for 12 months. The preferred fiber constituent for the sediment barriers of the present invention would retain 70% tensile strength for 12 months of exposure, but specifying agencies could require degradation spans from 3 months to about 36 months and find commercial products to meet these standards.

Each anchor 15 and 16 is a generally U-shaped staple fabricated from wire or rod stock and having at least one elongated leg extending outwardly from the closed end 25 of the staple. The end 27 of each leg remote from the closed end 25 preferably is formed at an acute angle which helps penetrate the soil when the barrier is being installed in a channel. The closed end 25 of each anchor extends through the barrier 10 adjacent the foundation 12, and preferably either within or immediately above the adhesive 22 which unites the strands of the barrier. This placement of the closed end 25 for each anchor helps retain the anchor on the barrier. The passage of the closed end 25 through the thickness of the barrier 10 preferably is such as to permit pivoting movement of the barrier around the closed end, as this pivoting movement facilitates optimal placement of the anchors when the barrier 10 is installed in a channel.

Figure 3:
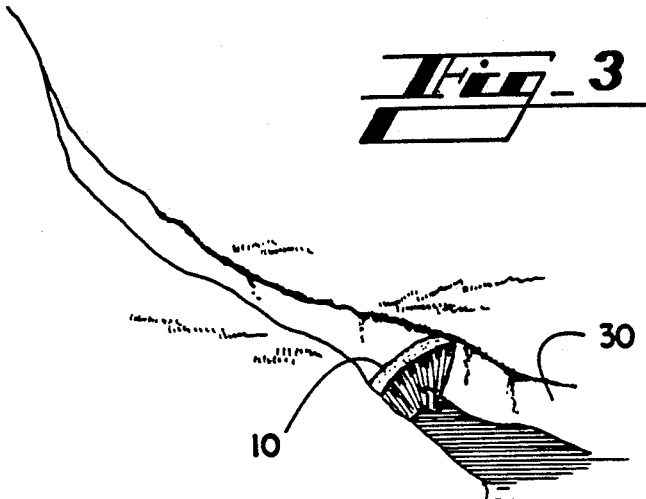
FIG. 3 is a pictorial view showing the rill barrier of FIG. 1 fixed in placed within a typical erosion channel.
Figure 4:
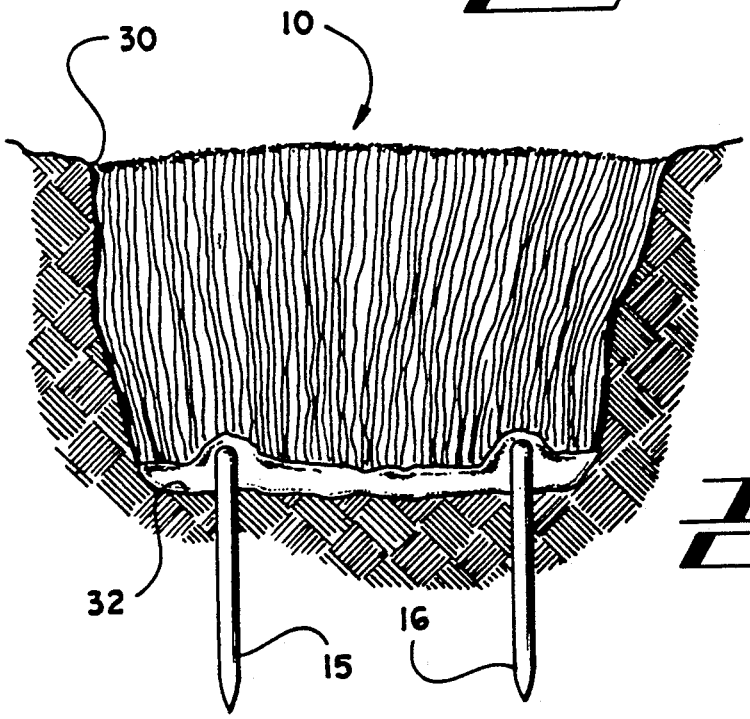
FIG. 4 is a side view showing the rill barrier of FIG. 1 in place within a rill.

Turning now to FIGS. 3 and 4, a typical application of the barrier 10 is shown installed within an erosion channel such as the rill 30 incised into the surface 31 of a slope. The barrier 10, with the anchors 15 and 16 preattached as described above, is placed by hand within the rill 30 such that the foundation 12 substantially confronts the bottom surface 32 of the rill. The length of the barrier 10 chosen for the particular rill 30 should substantially span the width of the rill, and the height of the barrier should substantially fill up the rill to the level of the adjacent surface 31. If a barrier 10 having the height necessary for that purpose is not available, a barrier may be used having height sufficient to accommodate the maximum depth of anticipated water runoff flowing through the rill.

The barrier 10 is anchored in place within the rill 30 by driving the anchors 15 firmly into the bottom surface 32 defining the rill. The pivotable connection between each anchor 15 and the barrier 10 allows the installer to drive each anchor into the earth at the angle which best fits the rill independently of the barrier placement within the rill.

With the permeable barrier 10 installed in the rill 30, the fibrous mass of the strands 11 reduces the velocity and energy of water flowing through the barrier in the rill, thereby reducing the erosive energy of that water flow. Furthermore, as the resistance of the fibrous mass reduces energy of the water flow, the rate of deposition of sediment or other eroded particles is increased at the location of the barrier, entrapping eroding sediment before the sediment particles can leave the site of the barrier.

Figure 5:
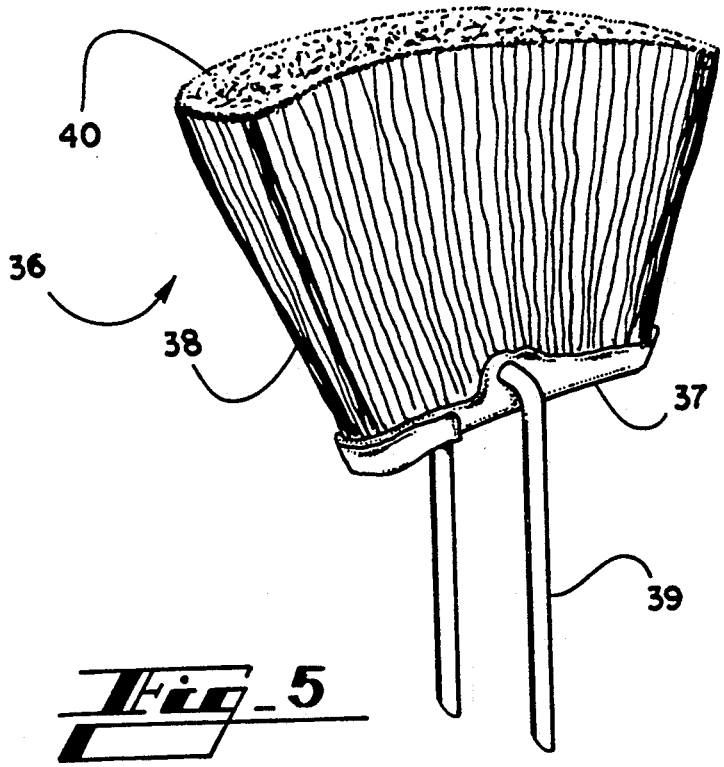
FIG. 5 is a pictorial view showing a rill barrier according to a second preferred embodiment of the present invention.
Figure 6:
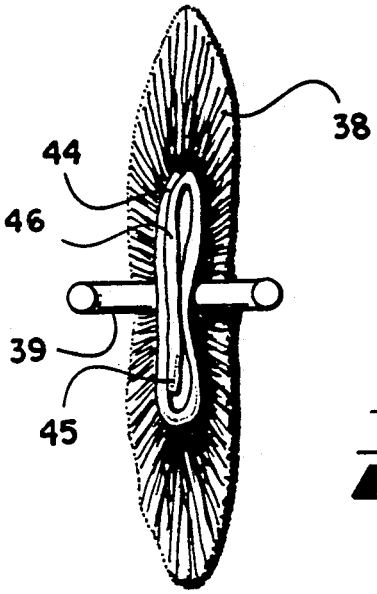
FIG. 6 is a bottom view of the rill barrier in FIG. 5, showing the multilayer construction of that rill barrier.

Turning next to FIGS. 5 and 6, the barrier 36 utilizes an alternative form of construction and also represents a barrier of shorter overall length intended for use in rills of relatively small corresponding size. The barrier 36, in common with the barrier 10 previously described, has a foundation 37 and a number of strands 38 anchored at the foundation and extending outwardly in a predetermined array. A single anchor 39 is attached to the barrier 36 at or adjacent the foundation 37, in much the same way as the anchors 15 and 16 of the previously described embodiment. While the size of the barrier 36 is a matter of design choice, determined by the sizes of rills in which the barrier is intended for use, an actual barrier as shown in 36 has a foundation with length of approximately 1.5 inches and strands 38 extending approximately 4.5 inches upwardly from the bottommost part of the foundation. Those fibers along the uppermost extent 40 of the barrier 36 fan outwardly to form an arcuate path approximately 6.5 inches long. The thickness of the barrier 36 near its outermost extent, as measured in the front-to-back dimension perpendicular to the paper in FIG. 5, is approximately two inches.

FIG. 6 shows that the barrier 36 is fabricated in a manner to increase the thickness of the barrier. This effect is obtained by initially preparing the barrier with a single foundation 37 and strands 38 emanating outwardly therefrom, in much the manner of the barrier 10 previously described. The ends 44 and 45 of the barrier 37 next are folded back to lie against the midpoint of the foundation such that the ends overlap each other as shown at 46 in FIG. 5. The overlapping and folded-back portions of the foundation 37 are pressed substantially flat against each other and are secured with adhesive to form the foundation in the overlapped condition depicted in FIG. 6. The resulting overlapped configuration produces a barrier 36 having greater front-to-back thickness and increased bushiness in that dimension, than is readily attainable with a barrier having a single and generally linear foundation.

Figure 7:
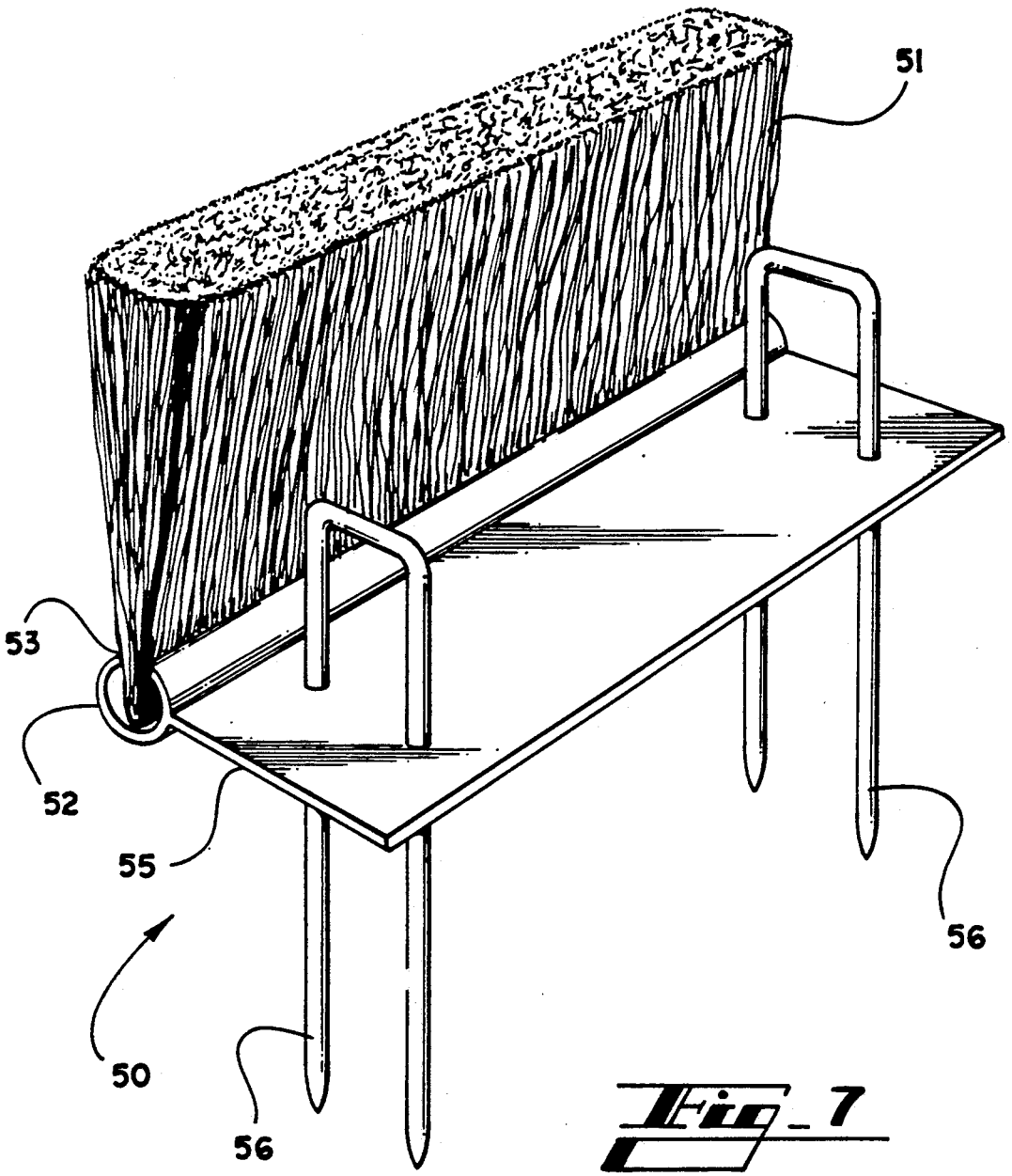
FIG. 7 is a pictorial view showing a shaped barrier according to a third preferred embodiment of the invention, for controlling sheet erosion.

FIG. 7 shows a shaped barrier 50 particularly intended for placement on a sloped surface to combat sheet erosion resulting from water flow along that surface. The barrier 50 typically is longer than the rill barriers previously described, although the length of the barrier is determined by the span of the slope on which the barrier is intended for use. Moreover, it will become apparent that two or more barriers 50 can be placed end-to-end across a slope.

The barrier has a number of strands 51 extending outwardly from the foundation 52, with the strands laying alongside one another in a substantially parallel fashion as with the barrier 10. The foundation 52 includes an elongated tubular hollow member preferably made of an elastomer for flexibility when laying on an irregular surface. A slit 53 extends along the top in communication with the hollow interior of the foundation, and the strands 51 extend outwardly through the slit. The strands are folded discrete lengths of fiber as previously described, and the closed ends of the strands are maintained within the foundation by adhesive bonding or by attachment to a backing material as previously described.

A flexible flat anchor sheet 55 is connected to the foundation 52 at a 90° angle to the slit 53 and the strands 51 extending through the slit. The anchor sheet 55 preferably is coextensive with the length of the foundation 52.

The barrier 50 in use is laid across a sloped surface where sheet erosion is an actual or anticipated problem. The barrier 50 is placed so that the anchor sheet 55 is on the uphill side of the foundation, and a pair of staples pierce the anchor sheet 55 and are driven into the ground to secure the barrier 50 in place. The staples 56 are shown in FIG. 7 partially extending through the anchor sheet. The strands 51 are sufficiently stiff to remain substantially upright notwithstanding the effect of surface water flowing over the anchor sheet 55 to strike the strands and flow through the barrier 50, so that the barrier reduces the erosive velocity of the water flow over the sloped surface and induces sedimentation from that flow.

The shaped barriers according to the present invention may be produced in various lengths to fit across watercourses of corresponding widths, or may be produced in one or more extended lengths from which one can cut a barrier of selected length. The latter approach is particularly applicable to the barrier embodiment shown in FIG. 7, where the barrier typically spans a surface of several feet. The staples 56 in that case are attached to the anchor sheet after a barrier of desired length is cut from an available supply.

It should be understood that the foregoing relates only to preferred embodiments of the present invention, and that numerous changes and modifications therein may be made without departing from the spirit and scope of the invention as defined in the following claims.

We claim:

1. An erosion control barrier for placement onto a normally dry watercourse subject to erosion from surface water runoff over the watercourse, comprising:

a structured array of fibers having a predetermined and uninterrupted orientation which spans across the entire width of the watercourse;

means fixing the fiber array in the predetermined orientation;

attachment means operatively associated with the array at the fixing means and extending therefrom, wherein the attachment means has a distal end with a point operative to penetrate the earth in the watercourse and thereby secure the structured array of fibers in fixed relation to the watercourse; and the fibers having stiffness sufficient to remain substantially upright when the array is thus fixed in a dry watercourse and when surface water is flowing on the watercourse, so that the structure of fibers reduces the energy of water flowing along the watercourse and thereby causes deposition of sediment carried through the array by the flowing water and also entraps entrained particles of sediment within the fibrous structure.

2. An erosion control apparatus for placement into a rill or other watercourse formed in the earth and subject to erosion from surface water runoff over the watercourse, comprising:

a plurality of strands emanating from a foundation in common to all the strands and forming a structured and uninterrupted linear array which spans the entire width of the watercourse;

means associated with the foundation to unite the strands and thereby maintain the certain shape of the array;

means engaging the array at the foundation and extending therefrom to retain the array disposed in fixed relation on the watercourse wherein the means engaging the array has a distal end with a point securing the array therewithin; and the strands being sufficiently stiff to remain substantially upright when the array is thus fixed in a dry watercourse and when the strands are subjected to surface water flowing on the watercourse, so that the array of strands reduces the energy of water flowing along the watercourse and thereby causes deposition of sediment carried through the array by the flowing water and also entraps entrained particles of sediment within the structured array.

3. Apparatus as in claim 2, wherein:

the strands radiate outwardly from the foundation; and the engaging means extends outwardly from the foundation along a path apart from the strands.

4. Apparatus as in claim 3, wherein:

the engaging means comprises a generally U-shaped staple having at least one elongate leg extending outwardly from a closed end; and the staple engages the array of strands with the foundation movably retained in the closed end of the staple, so that the array can be moved to one side of the staple while the leg of the staple is being inserted into the earth.

5. Apparatus as in claim 2, wherein:

the uniting means comprises an adhesive mass engaging the strands as arranged in said certain array, so that the adhesive mass secures the strands to maintain the structure of the array.

6. Apparatus as in claim 5, wherein:

the array is substantially flat, with the strands emanating outwardly from an edge of the array and with the adhesive mass disposed along the edge to engage the strands and maintain the structure of the array.

7. Apparatus as in claim 2, wherein:

the means engaging the array extends from the foundation at a substantial angle to the structured array so as to maintain the strands erect and extending outwardly from a surface of the watercourse with said means disposed in fixed relation on the watercourse.

8. Apparatus as in claim 7, further comprising means extending downwardly from the engaging means to penetrate the surface of the watercourse and secure the structured array in place thereon.

9. Apparatus as in claim 7, wherein:

the means engaging the array joins the foundation and extends forwardly therefrom to lie on the watercourse with the strands emanating substantially outwardly from the watercourse; and further comprising:

means securing the array-engaging means to the watercourse so that the structured array remains in position to impede the flow of water therealong.

10. Apparatus as in claim 2, wherein:

the means engaging the array comprises a panel joining the foundation and extending in a forward direction therefrom to lie substantially on the earth surface forming the watercourse; and means engaging the panel to extend downwardly therefrom and engage the subjacent earth, thereby securing the panel in fixed relation to the watercourse, so that the panel maintains the foundation on the watercourse at a certain orientation which keeps the strands of the structured array extending substantially outwardly from the surface.

11. Apparatus as in claim 10, wherein:

the panel extends forwardly from the foundation at substantially a right angle to the strands emanating from the foundation, so as to maintain the strands substantially perpendicular to the surface on which the panel is affixed.

* * * * *